US007987652B2

(12) United States Patent
Corniani

(10) Patent No.: US 7,987,652 B2
(45) Date of Patent: Aug. 2, 2011

(54) CAPPING HEAD

(75) Inventor: Carlo Corniani, Marmirolo (IT)
(73) Assignee: Weightpack S.p.A., Goito (IT)

( * ) Notice: Subject to any disclaimer, the term of this patent is extended or adjusted under 35 U.S.C. 154(b) by 685 days.

(21) Appl. No.: 11/989,961

(22) PCT Filed: Jul. 27, 2006

(86) PCT No.: PCT/EP2006/007437
§ 371 (c)(1),
(2), (4) Date: Feb. 4, 2008

(87) PCT Pub. No.: WO2007/017131
PCT Pub. Date: Feb. 15, 2007

(65) Prior Publication Data

US 2010/0281825 A1 Nov. 11, 2010

(30) Foreign Application Priority Data

Aug. 10, 2005 (IT) ..... MN2005A0052

(51) Int. Cl.
*B67B 3/20* (2006.01)

(52) U.S. Cl. ..... 53/317; 53/331.5; 53/490

(58) Field of Classification Search ..... 53/331.5, 53/420, 490, 317, 484, 485
See application file for complete search history.

(56) References Cited

U.S. PATENT DOCUMENTS

| | | | | |
|---|---|---|---|---|
| 4,277,929 | A | 7/1981 | Schindel | |
| 4,662,153 | A | 5/1987 | Wozniak | |
| 4,674,264 | A * | 6/1987 | Ellis et al. | 53/331.5 |
| 5,207,048 | A * | 5/1993 | Wysocki | 53/133.2 |
| 5,423,159 | A * | 6/1995 | Bankuty et al. | 53/317 |
| 5,467,527 | A * | 11/1995 | Zanini et al. | 29/773 |
| 5,584,161 | A * | 12/1996 | Zanini et al. | 53/317 |

FOREIGN PATENT DOCUMENTS

| | | |
|---|---|---|
| AU | 630 331 B | 10/1992 |
| EP | 0 559 946 A | 9/1993 |

* cited by examiner

*Primary Examiner* — Thanh K Truong
(74) *Attorney, Agent, or Firm* — Modiano & Associati; Albert Josif; Daniel O'Byrne

(57) ABSTRACT

A capping head comprising a support adapted to be associated with means arranged within a capper comprising at least two identical working units, which are associated with the support and are motorized in the same direction, each working unit comprising a shaft provided with motor drive means, which is connected, with the interposition of a torque-limited coupling, to a transverse arm adapted to support a rotating roller, both rollers are designed to come into contact with a cap to be screwed onto a container.

5 Claims, 5 Drawing Sheets

CAPPING HEAD

TECHNICAL FIELD

The present invention relates to a capping head.

BACKGROUND ART

It is known that caps, both simple caps and caps provided with a spray pump or a dispenser, are screwed onto containers by means of machines, known as cappers, which in a widespread embodiment comprise a rotating turret for supporting and moving a plurality of capping heads, which act so as to grip a cap which is conveyed to them in order to screw it onto a container which is arranged below and then release the capped container; obviously, in the execution of the described operations, each capping head is moved by elements arranged within the turret so as to perform translational motions in a direction which is parallel to the axis of the turret.

Currently known capping heads are not entirely satisfactory, especially due to their considerable constructive complexity, and therefore the aim of the present invention is to provide a capping head that has high functional features and at the same time has great constructive simplicity.

DISCLOSURE OF THE INVENTION

This aim and objects are achieved by a capping head according to the invention, comprising a support adapted to be associated with means arranged within a capper in order to be actuated so as to perform appropriate translational motions, characterized in that it comprises at least two identical working units, which are associated with said support and are motorized in the same direction, each working unit comprising a shaft provided with motor drive means, which is connected, with the interposition of a torque-limited coupling, to a transverse arm adapted to support a rotating roller, which is designed to come into contact with a cap to be screwed onto a container and is kinematically connected to said shaft.

BRIEF DESCRIPTION OF THE DRAWINGS

Further characteristics and advantages of the capping head according to the present invention will become better apparent from the description of a preferred but not exclusive embodiment thereof, illustrated by way of non-limiting example in the accompanying drawings, wherein.

WAYS OF CARRYING OUT THE INVENTION

Figure 1:
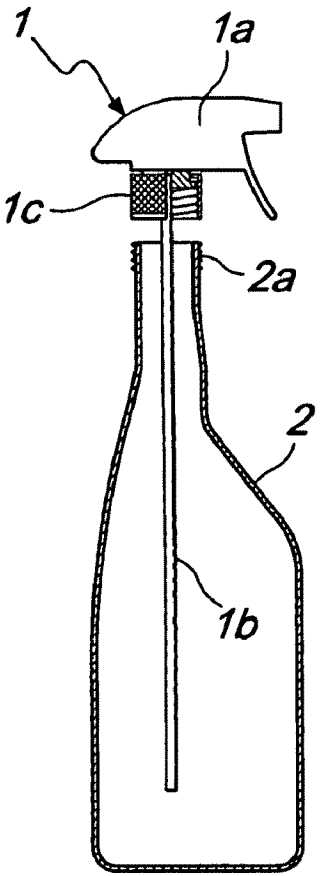
FIG. 1 is an elevation view of a container with a pump cap, of a type designed to be processed by means of the capping head according to the invention.

With reference to the figures, and in particular to FIG. 1, reference numeral 1 generally designates a cap comprising a pump 1*a* adapted to atomize liquid drawn from a container 2 by means of a tube 1*b* and further comprising a threaded ring 1*c*, which is designed to be screwed onto a thread 2*a* of the container 2 in order to fix the cap 1 on said container.

Figure 3:
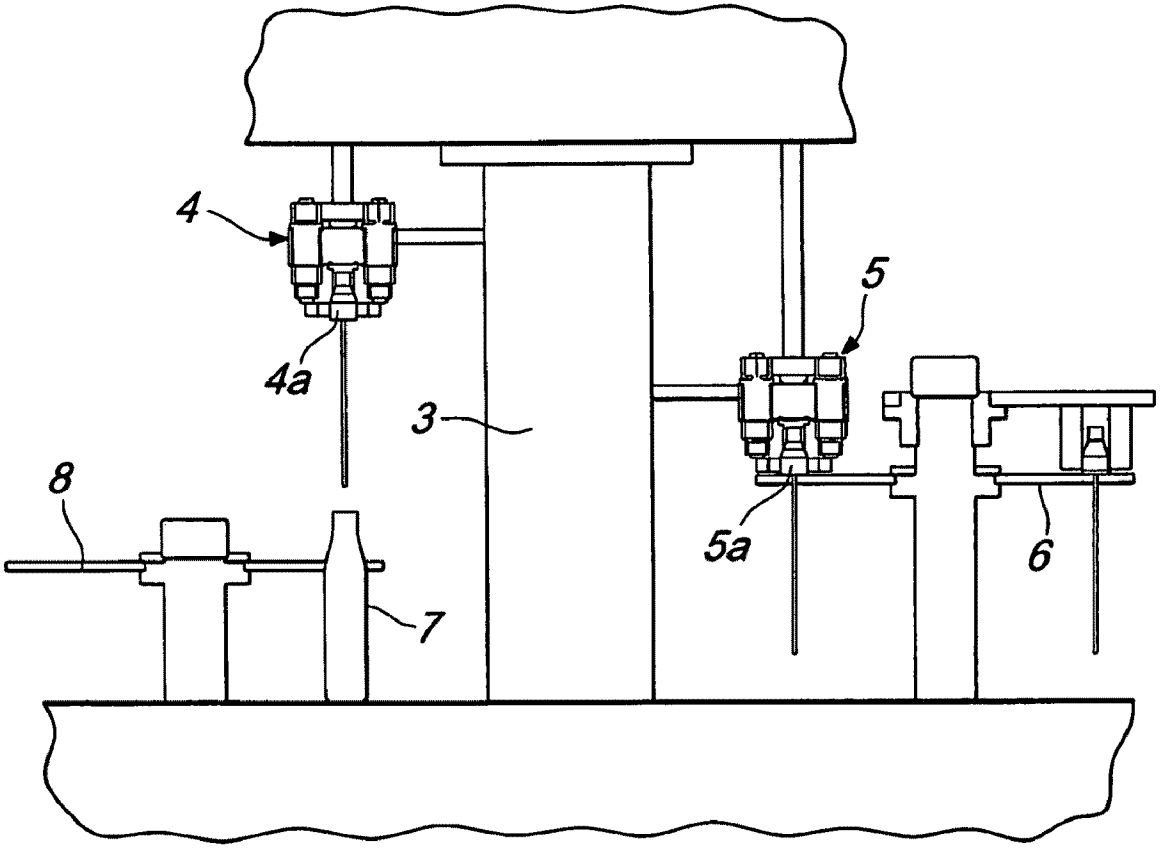
FIGS. 2 and 3 are respectively a plan and an elevation schematic view of a capper comprising capping heads according to the invention.
Figure 2:
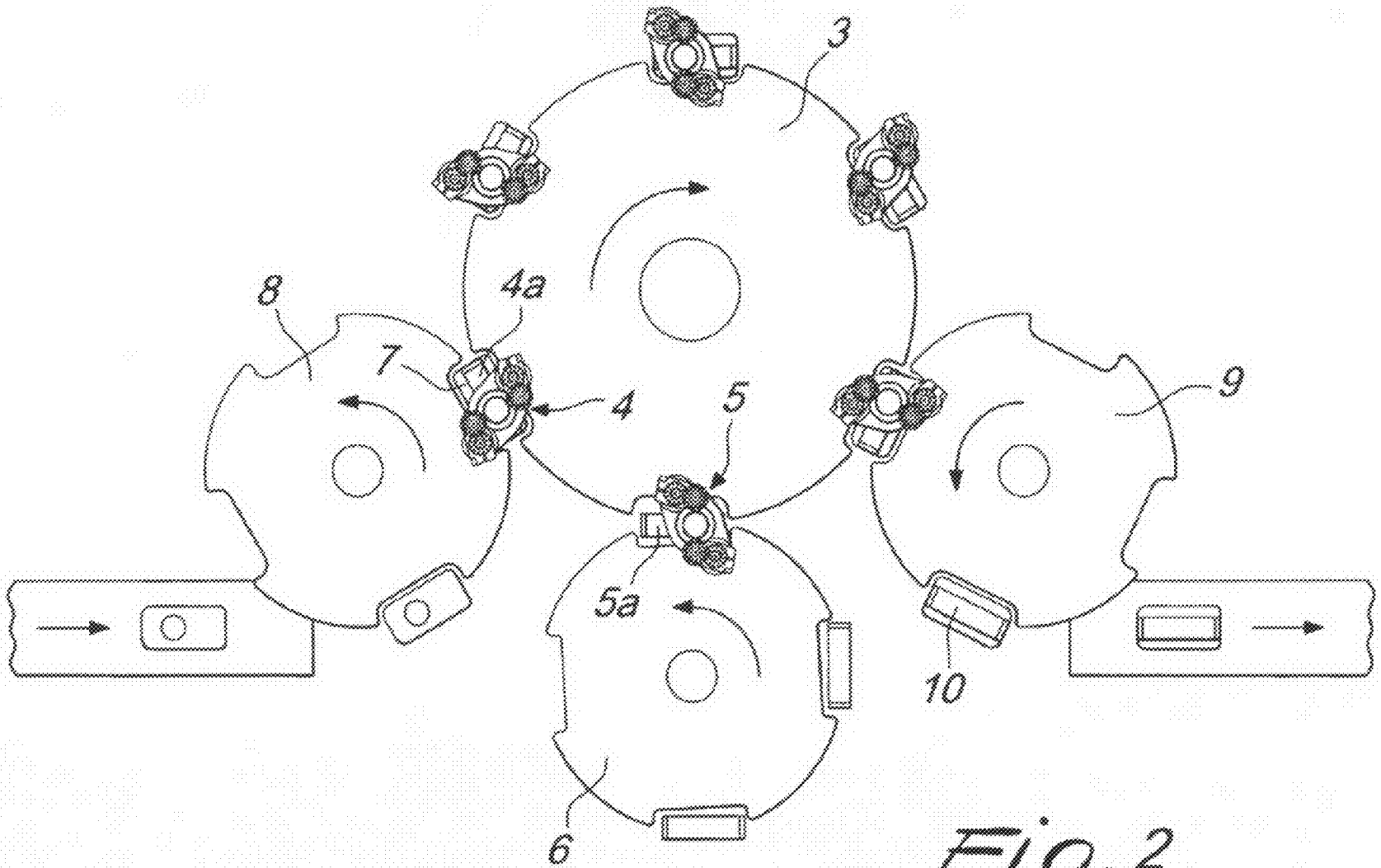

With reference to the schematic FIGS. 2 and 3, it can be seen that the capper comprises a rotating turret 3, which supports a plurality of capping heads 4 and 5, each whereof is adapted to grip a cap 4*a*, 5*a* conveyed by a star conveyor 6 so as to screw it onto a container 7 guided by a star conveyor 8, and convey the capped container to an output star conveyor 9: reference numeral 10 designates a capped container being handled by the star conveyor.

Within the rotating turret 3 elements are provided which produce movements of the capping heads in a direction which is parallel to the axis of the turret; the movements of the capping heads are required in order to perform the operating cycle that the machine must perform.

With reference to FIGS. 4 to 9, a capping head according to the invention is now described.

The capping head, generally designated by reference numeral 11, comprises a support 12, which is associated with the rotating turret 3 and to which two identical working units, generally designated by reference numerals 13 and 14 respectively, are connected; the working units are arranged on opposite sides with respect to the centering element of a cap 15 constituted by a cradle 16; reference numeral 15*a* designates the threaded ring of the cap 15.

The working unit 13 comprises a shaft 17, which receives its motion by means of a gear 17*a*, with which it is provided, from a gear 18*a*, which is keyed to a shaft 18 associated with the rotating turret 3, and transmits it to a sleeve 19, which is rotatably associated with antifriction bushes 19*a*, 19*b* on the support 12 by means of the compliant or torque-limited coupling comprising a driving ring 20*a* with permanent magnets and a driven ring 20*b* made of a material having low magnetic hysteresis; the ring 20*a* is rigidly coupled to the shaft 17 and the ring 20*b* is rigidly coupled to the sleeve 19.

A transverse arm 21 is rigidly coupled to the sleeve 19 and supports, so that it can rotate on bearings 22, a pivot 23 of a roller 24 designed to come into contact with the ring 15*a* of the cap 15, and a gear 25 is keyed onto the pivot 23 and meshes with a gear 17*b* provided at the end of the shaft 17.

As mentioned, the working unit 14 is identical to the described working unit 13, and so the shaft with which it is provided is motorized in the same direction as the shaft 17 of the unit 13 by means of a gear 26*a*, which is keyed to said shaft and meshes with the gear 18*a*.

Said shaft further transmits motion by means of a torque-limited or compliant coupling to a sleeve, which can rotate within the support 12, of which only an edge 27 is visible in the figures, and a transverse arm 28 is rigidly coupled to said sleeve and supports rotatably the pivot of a roller 29 that is designed to come into contact with the ring 15*a* of the cap 15; a gear 30 is keyed to said pivot, not shown in the figures, and meshes with a gear 26*b* provided at the end of the shaft.

Operation of the capping head of the invention is extremely simple.

Figure 4:
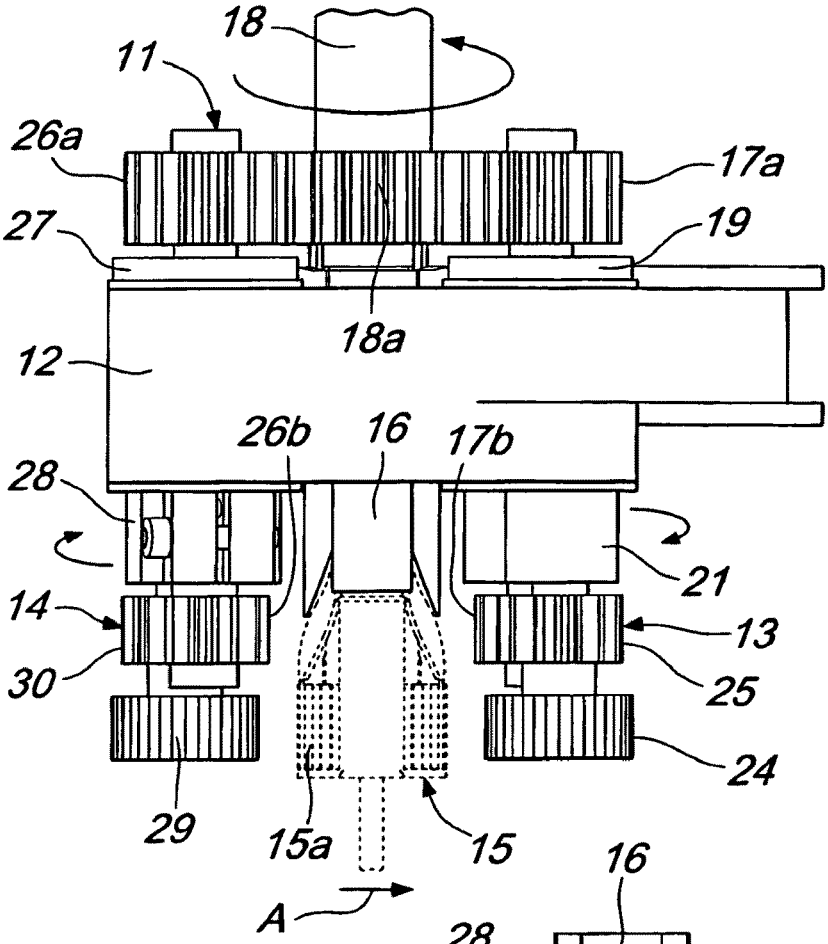
FIGS. 4 and 5 are respectively a side view and a view from below of the capping head in the open condition.

When the capping head 11 must grip the cap 15 associated with the cradle 16, the shaft 18 is turned by elements arranged within the rotating turret 3 in the direction of the arrow shown in FIG. 4.

Figure 5:
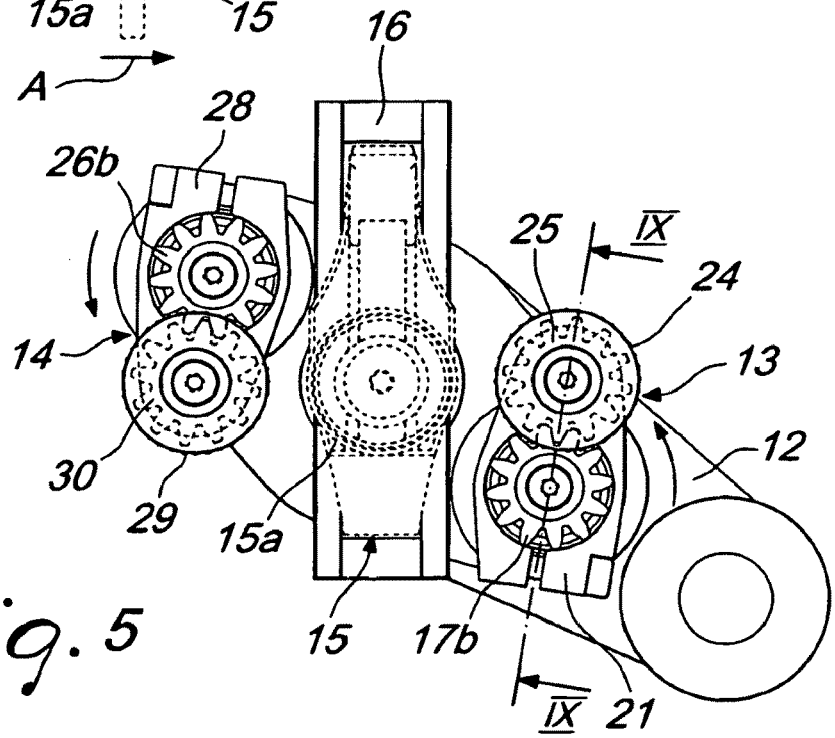

Accordingly, the shaft 17 of the working unit 13 and the corresponding shaft of the working unit 14 are turned and rotate, by means of the torque-limited couplings with which they are provided, the corresponding sleeves 19 for the unit 13; therefore, the arms 21 and 28 rotate in the direction of the arrows shown in FIGS. 4 and 5, accordingly producing the gradual approach of the rollers 24 and 29 to the threaded ring 15*a* of the cap 15.

When the rollers 24 and 29 make contact with the ring 15*a*, the rotation of the arms 21 and 28 is blocked, but the shaft 18 continues to turn, and the shafts of the two working units, such as 17 for the unit 13, continue with it.

Figure 6:
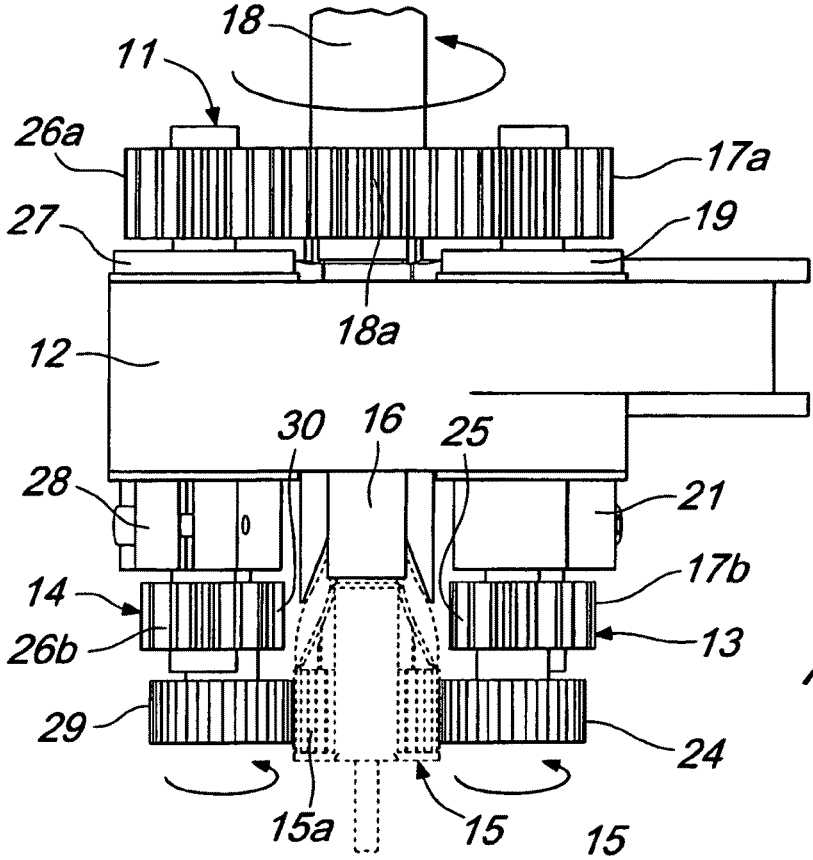
FIGS. 6 and 7 are similar to the views of the preceding figures but show the capping head in the condition in which it is closed on the cap.
Figure 7:
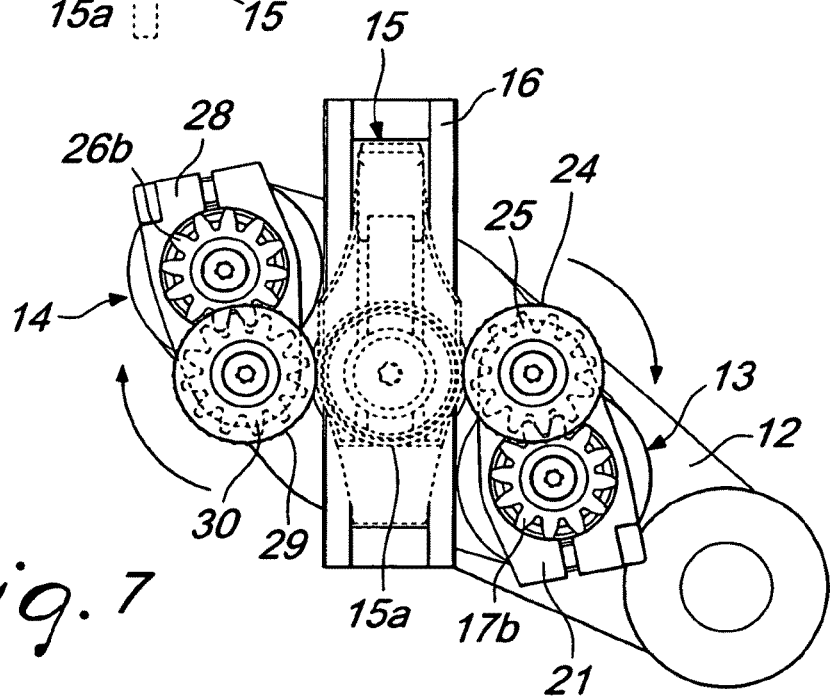
Figure 8:
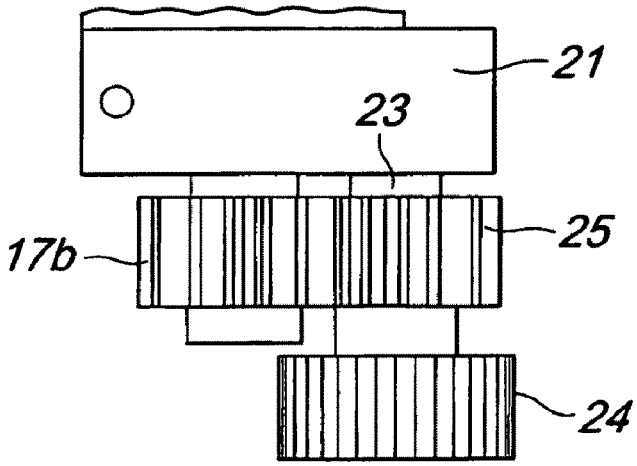
FIG. 8 is a partial side view, taken from A, of a working unit according to the indication of FIG. 4.
Figure 9:
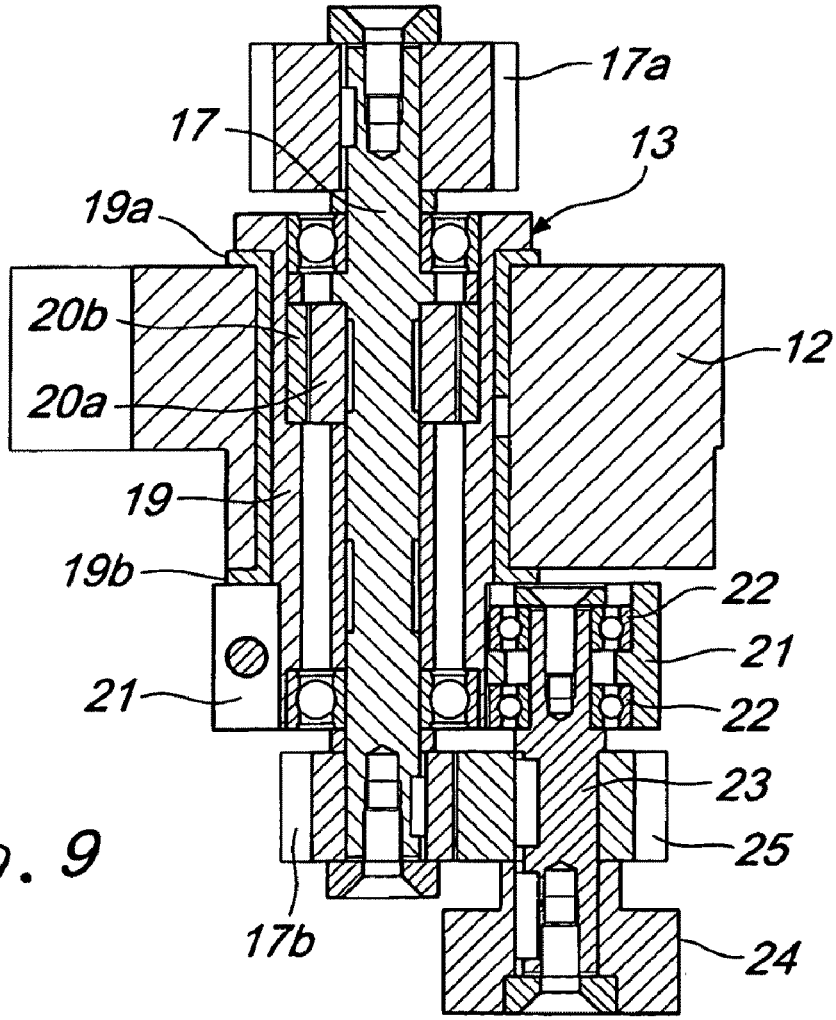
FIG. 9 is a sectional view, taken along the line IX-IX of FIG. 5.

The action of the torque-limited couplings between the shafts and the corresponding sleeves is then interrupted, and the shafts turn, by means of the pairs of gears, respectively 17*b*, 25 and 26*b*, 30, the rollers 24 and 29, which, upon contact with the threaded ring 15*a*, screw it onto the intended container; this situation is shown by the arrows of FIGS. 6 and 7.

Once screwing has ended, the shaft 18 reverses its direction of rotation, the arms 21 and 28 open again, and the capped container is released by the capping head.

The described invention is susceptible of numerous modifications and variations, all of which are within the scope of the appended claims: thus, for example, three or more working units may be provided, and the torque-limited coupling may be provided by means of a mechanical clutch or other device.

In the practical execution of the invention, all the details may be replaced with other technically equivalent elements.

The disclosures in Italian Patent Application no. MN2005A000052, from which this application claims priority, are incorporated herein by reference.

The invention claimed is:

1. A capping head for a capper comprising a rotating turret, the capping head comprising a support adapted to be associated with means arranged within the capper in order to be actuated so as to perform translational motions parallel to an axis of rotation of the turret of the capper, at least two identical working units, which are associated with said support and are motorized in a same direction by motor drive means, each working unit comprising a shaft which is connected, with interposition of a torque-limited coupling, to a tansverse arm adapted to support a rotating roller, which is designed to come into contact with a cap to be screwed onto a container and is kinematically connected to said shaft, each said shaft of each working unit being connected by means of said torque-limited coupling to a sleeve which is rotatably associated with the support, the transverse arm that rotatably supports the roller being connected kinematically to said shaft by means of a pair of gears, said pair of gears comprising one gear connected to said shaft and and another gear keyed on a pivot of said roller supported by said traverse arm.

2. The capping head according to claim 1, wherein the motorized shaft of each working unit is provided with a gear which meshes with a single gear keyed on a shaft associated with means arranged within the capper.

3. The capping head according to claim 1, wherein the torque-limited coupling comprises a driving ring with permanent magnets and a driven ring made of a material having low magnetic hysteresis.

4. The capping head according to claim 1, wherein the torque-limited coupling comprises a mechanical clutch device.

5. The capping head according to claim 1, wherein said two working units are arranged on opposite sides with respect to a cap centering elements, which protrudes from the support.

* * * * *